United States Patent [19]

Butke

[11] Patent Number: 4,758,362

[45] Date of Patent: Jul. 19, 1988

[54] CARBAMATE ADDITIVES FOR LOW PHOSPHORUS OR PHOSPHORUS FREE LUBRICATING COMPOSITIONS

[75] Inventor: Betsy J. Butke, Mentor, Ohio

[73] Assignee: The Lubrizol Corporation, Wickliffe, Ohio

[21] Appl. No.: 841,061

[22] Filed: Mar. 18, 1986

[51] Int. Cl.[4] ..... C10M 135/18

[52] U.S. Cl. ..... 252/47.5; 252/47.0; 252/77; 252/78.1; 558/49; 558/51; 558/52; 564/75

[58] Field of Search ..... 252/47, 47.5; 564/75; 558/49, 51, 52

[56] References Cited

U.S. PATENT DOCUMENTS

| | | | |
|---|---|---|---|
| 2,067,494 | 1/1937 | Lichty | 260/99.11 |
| 2,710,872 | 6/1955 | Thompson | 260/326.5 |
| 2,841,530 | 7/1958 | Andersen et al. | 167/87.1 |
| 2,897,152 | 7/1959 | Elliott et al. | 252/47.5 |
| 3,211,771 | 10/1965 | Bikales | 260/455 |
| 3,833,496 | 9/1974 | Malec | 252/33.6 |
| 3,878,236 | 4/1975 | Gates et al. | 558/49 |
| 3,890,363 | 6/1975 | Malec | 260/455 |
| 4,008,190 | 2/1977 | Taylor et al. | 564/75 |
| 4,064,265 | 12/1977 | Varsanyi | 424/300 |
| 4,130,578 | 12/1978 | Wight | 260/455 A |
| 4,161,534 | 7/1979 | Schweizer | 424/300 |
| 4,202,832 | 5/1980 | Fischer et al. | 260/455 A |
| 4,254,142 | 3/1981 | Anderson et al. | 424/300 |

*Primary Examiner*—William R. Dixon, Jr.
*Assistant Examiner*—Ellen McAvoy
*Attorney, Agent, or Firm*—James L. Cordek; Denis A. Polyn; Joseph P. Fischer

[57] ABSTRACT

A phosphorus free or a low phosphorus containing lubricant composition is provided by formulating the composition with an additive of the formula

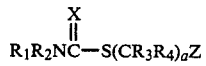

(I)

wherein $R_1$ and $R_2$ are independently alkyl of 1 to about 7 carbons, aryl, aralkyl or together form an alicyclic or heteroalicyclic radical in which the ring is completed through the nitrogen; X is O or S; a is 1 or 2; $R_3$ and $R_4$ are independently H, alkyl or aryl; and Z is

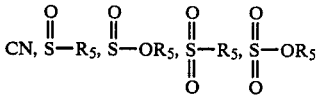

wherein $R_5$ is hydrogen, alkyl, or aralkyl, and

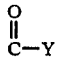

wherein Y is H, OH, $R_6$ where $R_6$ is alkyl, aryl or aralkyl, $OR_6$, $OR_7$—OH, where $R_7$ is alkylene of 1 to about 7 carbon atoms, and $NR_8R_9$ where $R_8$ and $R_9$ are independently hydrogen, alkyl, cycloaliphatic, heteroalicyclic or together form an alicyclic or heteroalicyclic radical in which the ring is completed through the nitrogen; with the proviso that when a is 1, Y is not $OR_6$.

These additives impart improved extreme pressure and anti-wear properties to lubricant compositions.

5 Claims, No Drawings

CARBAMATE ADDITIVES FOR LOW PHOSPHORUS OR PHOSPHORUS FREE LUBRICATING COMPOSITIONS

BACKGROUND OF THE INVENTION

1. Field of the Invention

This invention relates to various carbamate additives for lubricating compositions. More specifically, this invention relates to carbamate additives derived from the reaction of an amine with carbon disulfide and a reactant containing an activated, ethylenically unsaturated bond or an alpha-chloro or alpha-bromo carboxylic acid or derivative thereof. These additives impart improved extreme pressure and anti-wear properties to lubricating compositions, particularly lubricating compositions which are phosphorus-free or contain a very low phosphorus concentration.

2. State of the Art

Carbamate compounds derived from reactants containing activated, ethylenically unsaturated bonds which have a number of different utilities are known in the art. For example, U.S. Pat. No. 2,067,494 discloses various dithiocarbamates which are useful for accelerating the vulcanization of rubber.

U.S. Pat. No. 2,710,872 discloses dithiocarbamic acids and esters thereof which are useful as intermediates in the production of pharmaceuticals, bactericides, insecticides and anti-oxidants for lard.

In U.S. Pat. No. 2,841,530, various salts of dithiocarbamates are disclosed as being useful in the preparation of hair waving compositions.

U.S. Pat. No. 2,897,152 discloses turbine oils comprising a specific class of dithiocarbamate additives to impart extreme pressure properties in the oil.

In U.S. Pat. No. 3,211,711 2-cyanovinyl dithiocarbamates are disclosed for use in pesticide compositions.

In U.S. Pat. Nos. 3,890,363 and 3,833,496, a speeific class of dithiocarbamate compounds is disclosed as useful anti-oxidant and anti-wear additives for use in lubricating oils and greases.

U.S. Pat. No. 4,130,578 discloses various (alkoxycarbonyl) alkyl esters of dithiocarbanilic acid, which are useful as immunoregulatory agents for treatment of organ transplant rejection and other immune diseases.

U.S. Pat. No. 4,064,265 discloses dithiocarbamic acid esters useful as anthelmintics.

In U.S. Pat. No. 4,254,142, norbornylthio- and dithiocarbanilic acids are disclosed as being useful as immunosuppressive agents.

U.S. Pat. No. 4,161,534 discloses phenyloxyphenyl or phenylaminophenyl substituted dithiocarbamates which are useful as anthelmintic agents.

U.S. Pat. No. 4,202,832 discloses various thiocarbamoylthio fatty acid derivatives which are useful as lipid-lowering agents.

None of the foregoing disclosures, however, teach the class of carbamate additives of the present invention which are useful as additives for lubricating compositions.

SUMMARY OF THE INVENTION

In accordance with the present invention, a low phosphorus content or phosphorus-free lubricating composition comprising a specific class of carbamate additives has been developed. The carbamate additives of the present invention impart improved extreme pressure properties and anti-wear properties to lubricating compositions.

Further, in accordance with the present invention, lubricant compositions including automatic transmission fluids, hydraulic fluids and greases, comprising the carbamate additives of the present invention, as well as concentrates thereof, are provided.

Still further in accordance with the present invention, an efficient method for preparing carbamate compounds which are useful as extreme pressure agents and anti-wear additives in lubricant compositions, is provided.

These and other aspects of the invention will become clear to those skilled in the art upon the reading and understanding of the specification.

DETAILED DESCRIPTION OF THE INVENTION

Additives are conventionally added to lubricant compositions and greases to improve their properties. In the past, additives, such as zinc dialkyldithiophosphates, have been formulated with lubricating oil and grease compositions to improve the anti-wear and anti-oxidant properties of the lubricating oil or grease composition. Other chemistries or additives have also been included in the particular lubricant or grease to effect other properties, e.g., polybutenyl succinic acids and derivatives thereof have been added to improve the dispersancy of lubricating oils. While zinc dialkyldithiophosphates are quite effective as anti-wear agents and anti-oxidants, there is a need in the industry for specially formulated lubricants and greases that contain no phosphorus or only a very low concentration of phosphorus.

The Applicant has discovered that a specific class of carbamate compounds is effective in improving extreme pressure and anti-wear properties in lubricating oil and grease compositions where it is desired that the lubricating oil or grease composition contains no phosphorus or a very low concentration of phosphorus.

The carbamate additives of the present invention are illustrated by the following formula:

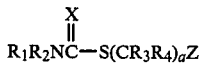

(I)

wherein $R_1$ and $R_2$ are independently alkyl of 1 to about 7 carbons, aryl, aralkyl or together form an alicyclic or heteroalicyclic radical in which the ring is completed through the nitrogen; X is O or S; a is 1 or 2; $R_3$ and $R_4$ are independently H, alkyl or aryl; and Z is

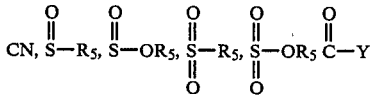

wherein $R_5$ is hydrogen, alkyl, or aralkyl, and wherein Y is H, OH, $R_6$, $OR_6$ where $R_6$ is alkyl, aryl or aralkyl, $OR_7$—OH, where $R_7$ is alkylene of 1 to about 7 carbon atoms, and $NR_8R_9$ where $R_8$ and $R_9$ are independently hydrogen, alkyl, cycloaliphatic, heteroalicyclic, or together form an alicyclic or heteroalicyclic radical in which the ring is completed through the nitrogen; with the proviso that when a is 1, Y is not $OR_6$.

A preferred group of compounds within the scope of the invention is defined by the above formula where X is S, $R_3$ and $R_4$ are independently H or alkyl, a is 2 and Z is $$\overset{O}{\overset{\|}{C}}-Y$$

wherein Y is OH, $R_6$, $OR_6$, $OR_7$—OH, where $R_7$ is alkylene of 1 to about 7 carbon atoms or $NR_8R_9$.

A most preferred group of compounds is defined by the above formula where X is S, $R_3$ and $R_4$ are H or methyl, and Y is OH, $OR_6$, wherein $R_6$ is methyl or ethyl; $OR_7$—OH, where $R_7$ is alkylene of 1 to about 4 carbon atoms and $NR_8R_9$ wherein $R_8$ and $R_9$ are H.

One advantage of using the above described carbamate compounds is that they may be prepared in a high yield, single step reaction. These compounds are derived from an amine, carbon disulfide or carbonylsulfide or source materials for these reactants and a reactant containing an activated, ethylenically-unsaturated bond or an alpha-chloro or alpha-bromo carboxylic acid or derivative thereof. These reactants are charged to a reactor and stirred without heating since the reaction is exothermic. Once the reaction reaches the temperature of the exotherm, the reaction mixture is held at a temperature within a range of the temperature of the exotherm to insure a complete reaction, followed by the removal of volatiles under reduced pressure. Following this procedure, the mixture is filtered and the final product is obtained in high yield.

With respect to the different reactants that may be utilized to prepare the compounds of the present invention, it has previously been pointed out that carbon disulfide ($CS_2$), carbonylsulfide (COS) or source materials for these reactants may be employed.

With respect to the amine reactants, secondary amines containing alkyl groups of 1 to about 7 carbon atoms, an aryl group, aralkyl group or a heteroalicyclic group where the nitrogen of the amine makes up the ring may be used. Specific amines which have been found to be useful within the scope of the present invention include dimethylamine, diethylamine, dipropylamine, dibutylamine, diamylamine, dihexylamine and diheptylamine. Also, there may be mentioned diphenylamine, dibenzylamine and the like. Furthermore, the non-symmetric amines such as N-methylethylamine, N-ethylbutylamine, N-ethylamylamine and the like may be found to be useful within the scope of the present invention. Likewise, N-amylaniline and the like may be used.

Among the suitable heterocyclics are aziridines, azetidines, azolidines, pyrrolidine, pyridine, di-, and tetra-hydropyridines, pyrroles, indoles, quinoline, morpholine, picolines, piperidine and the like. Mixtures of two or more of these heterocyclic amines can be used. Typical heterocyclic amines are the saturated 5- and 6-membered heterocyclic amines.

With respect to the reactants containing an activated, ethylenically unsaturated bond or an alpha-chloro or alpha-bromo acid, these reactants may be illustrated by the following formula:

$$(CR_{10}R_{11}(CR')_x(R'_3)_b)Z \qquad \text{(II)}$$

wherein $R_{10}$ and $R_{11}$ are independently H, alkyl, aryl, Cl or Br; R' is H, alkyl, aryl or aralkyl; x is 0 or 1, b is 0 or 1 where x+b is 1; $R'_3$ is H, alkyl or aryl, chloro or bromo and Z is $$CN,\ \overset{O}{\overset{\|}{S}}-R_5,\ \overset{O}{\overset{\|}{S}}-OR_5,\ \underset{\underset{O}{\|}}{\overset{O}{\overset{\|}{S}}}-R_5,\ \underset{\underset{O}{\|}}{\overset{O}{\overset{\|}{S}}}-OR_5,$$

wherein $R_5$ is H, alkyl or aralkyl, and $$\overset{O}{\overset{\|}{C}}-Y$$

wherein Y is H, OH, $R_6$ where $R_6$ is alkyl, aryl or aralkyl, $OR_6$, $OR_7$—OH where $R_7$ is alkylene of 1 to about 7 carbon atoms and $NR_8R_9$ where $R_8$ and $R_9$ are independently H, alkyl, cycloaliphatic, heteroalicyclic or together form an alicyclic or heteroalicyclic radical in which the ring is completed through the nitrogen; with the proviso that when x is 0, Y is not $OR_6$.

As specific species encompassed by the above Formula (II), there may be mentioned methylacrylate, ethylacrylate, 2-ethylhexylacrylate, 2-hydroxyethylacrylate, ethylmethacrylate, 2-hydroxyethylmethacrylate, 2-hydroxy-propylmethacrylate, 2-hydroxypropylacrylate, acrylamide, acrylonitrile, ethylsulfonylethene, methylsulfinylethene, and the like. Also, alpha-chloroacetic acid and alpha-bromoacetic acid and derivatives thereof may be used to prepare the compounds of the present invention.

The relative amounts of the reactants, discussed above, used to prepare the carbamate compounds of the present invention is not particularly critical. The charge ratios to the reactor can vary over a wide range where economics and the amount of the product desired are controlling factors. Thus, the charge ratio of the amine to the $CS_2$ or COS reactant to the ethylenically unsaturated reactant may vary 5:1:1 to 1:5:1 to 1:1:5. As a most preferred embodiment, the charge ratios of these reactants will be 1:1:1.

The preparation of specific compounds of the present invention are further illustrated in the examples that follow. While these examples are presented to show one skilled in the art how to operate within the scope of this invention, they are not to serve as a limitation on the scope of the invention where such scope is defined in the claims. It is pointed out that in the following examples, and elsewhere in the present specification and claims, all percentages, as well as all parts, are intended to express percent by weight and parts by weight unless otherwise specified.

EXAMPLE I

A 1-liter, 4-necked flask was fitted with a mechanical stirrer, thermometer, addition funnel and a water cooled reflux condenser. It was charged with 116 g 2-hydroxyethylacrylate and 76 g $CS_2$. Dibutylamine (129 g) was added over 3.1 hours with an exotherm to 47° C. The mixture was stirred for 2 hours. Heating was continued at 45°-55° C. and held at this temperature for 2.5 hours. The mixture was cooled. The mixture was vacuum stripped at 68° C. at 9 mm Hg. No distillate was collected. The reaction mixture was filtered through diatomaceous earth. The yield was 303 g of a clear, yellow liquid.

EXAMPLE II

A 1-liter flask was fitted with a mechanical stirrer, thermometer, addition funnel and a water-cooled, reflux condenser. The flask was charged with 71 g of acrylamide and 60 g of 95% ethanol. This mixture was stirred at room temperature for ¾ hour. An additional 40 g of 95% ethanol was added to completely dissolve the acrylamide. To the solution was added 76 g of $CS_2$. Diamylamine (157 g) was added over 1.23 hours. An exotherm to 41° C. occurred. This mixture was heated and held at 50°-55° C. for 3 hours. The mixture was subsequently vacuum stripped at 91° C. and 20 mm Hg to yield 113 g of distillate. The residue was filtered through diatomaceous earth filter aid with a filtrate yield of 281 g of clear, yellow, viscous liquid. This represented a 92.4% yield based on a theoretical yield of 304 g.

EXAMPLE III

A 1-liter flask was fitted with a mechanical stirrer, thermometer, an addition funnel and a Dry Ice/isopropanol condenser. The flask was charged with 157 g of diamylamine. $CS_2$(76 g) was added while stirring the mixture. This addition produced an exotherm to approximately 55° C. in approximately 50 minutes. To the flask were added 50 g of toluene after which 56 g of acrolein were added at 25° C. over ¾ hour. This addition produced an exotherm to 45° C. The mixture was stirred and allowed to cool to room temperature for 6 hours. This mixture was then stirred for another 4½ hours at 50° C. and allowed to stand overnight. The mixture was then vacuum stripped at 85° C. and 8 mm Hg to give 64 g of distillate. The residue was filtered through diatomaceous earth filter aid to give 240 g of filtrate, which was a clear, viscous red liquid. This represented an 83% yield based on 289 g theoretical.

EXAMPLE IV

A 1-liter flask was fitted with a mechanical stirrer, thermometer, addition funnel and a water-cooled, reflux condenser. The flask was charged with 172 g of methylacrylate and 156 g of $CS_2$. This mixture was stirred at room temperature and 146 g of diethylamine were added over 2¾ hours, producing an exotherm to 62° C. The mixture was then held at 55° C. for 2½ hours and then allowed to cool while standing overnight. The reaction mixture was then stirred and heated to approximately 55° C. and held at that temperature for 2 hours. The mixture was then vacuum stripped at 73° C. at 9 mm Hg. The residue was then filtered through diatomaceous earth filter aid to give 447 g of a clear, brown filtrate. This represented a 95.1% yield based on a theoretical yield of 470 g.

EXAMPLE V

A 1-liter flask was fitted with a mechanical stirrer, thermometer, addition funnel and a water-cooled, reflux condenser. The flask was charged with 86 grams of methylacrylate and 76 g $CS_2$. This mixture was stirred at room temperature and 129 g of dibutylamine were added. This addition took place over 2.17 hours and produced an exotherm to 53° C. The mixture was then heated and held at 55° C. for 4 hours. The mixture was then vacuum stripped to 76° C. at 8 mm Hg. The residue was then filtered through diatomaceous earth filter aid to give 274 g of a clear, yellow filtrate.

EXAMPLE VI

A 1-liter flask was fitted with a mechanical stirrer, thermometer, addition funnel and a water-cooled, reflux condenser. The flask was charged with 116 grams of 2-hydroxyethylacrylate and 76 grams $CS_2$. This mixture was stirred at room temperature and 157 g of diamylamine were added over 1.3 hours. This addition produced an exotherm to 68° C. The mixture was allowed to cool for 0.75 hour and stand overnight. The mixture was then heated and stirred to approximately 60°-65° C. for 2 hours. The mixture was then vacuum stripped at 98° C. at 10 mm Hg. A trace of distillate was collected. The residue was then filtered through 10 g of diatomaceous earth to give 332 g of a clear, yellow filtrate.

The compounds of the present invention as illustrated in the above examples have been found to be useful extreme pressure agents and anti-wear agents in preparing lubricating compositions of low phosphorus content or no phosphorus content. The compounds of the present invention may also find use as additives for other functional fluids including automatic transmission fluids and hydraulic fluids.

The carbamate compounds of the invention may be formulated with a lubricating oil or an automatic transmission fluid or the like by the direct blending of the composition with the particular oil or functional fluid to be formulated. The lubricating oil or other functional fluid may also be formulated with compounds of the present invention in the form of a concentrate. Such a concentrate may be prepared by adding 1% to about 99% by weight of at least 1 carbamate compound of the present invention to a substantially inert, normally liquid organic diluent or solvent such as benzene, toluene, xylene, petroleum naphtha, mineral oil, ethyleneglycol-mono-methylether or the like.

The amount of the carbamate additives formulated with a particular lubricant may vary over a wide range and must be an amount to effectively impart extreme pressure and anti-wear properties in the lubricant. As a preferred amount, the additive may range from 0.01 weight percent to about 10 weight percent of the formulated lubricant. In a most preferred embodiment, the amount may range from about 0.1 weight percent to about 5 weight percent of the formulated lubricant.

The compositions of the present invention formulated with the particular functional fluid may contain other additives and chemistries such as dispersants, antioxidants, and the like. Such other additives and chemistries include, for example, detergents and dispersants of the ash-producing or ashless type, corrosion- and oxidation-inhibiting agents, pour point depressing agents, auxiliary extreme pressure agents, color stabilizers and anti-foam agents. These other additives and chemistries are fully described and disclosed in U.S. Pat. No. 3,541,012; U.S. Pat. No. 3,697,428; and U.S. Pat. No. 4,234,435. The disclosures of these patents relating to such other additives and chemistries are hereby incorporated by reference for such disclosures.

A preferred dispersant according to the present invention is at least one substituted succinic acid or derivative thereof consisting of substituent groups and succinic groups wherein the substituent groups are derived from polyalkylene, said polyalkylene being characterized by a $\overline{M}n$ value of 500 to about 10,000 and a $\overline{M}w/\overline{M}n$ value of 1.0 to about 4.0.

It has also been found that the additive compounds of the present invention are useful in formulating various grease compositions. The carbamate additives of the present invention are useful in both mineral and synthetic lubricating oils and greases. Synthetic oils include polyolefin oils (e.g., polybutene oil, decene oligomer, and the like), synthetic esters (e.g., dinonyl sebacate, trioctanoic acid ester of trimethyolpropane, and the like), polyglycol oils, and the like. Greases are made from these oils by adding a thickening agent such as sodium, calcium, lithium, or aluminum salts of fatty acids such as stearic acid. The oils and greases of the present invention are prepared by blending an amount of the carbamate additive of the present invention sufficient to impart extreme pressure properties and anti-wear properties into the oil or grease. A useful concentration may range from about 0.1 to about 5 weight percent.

To further illustrate various functional fluid compositions, specifically lubricant compositions, comprising the compositions of the present invention the following illustrative examples are provided. It is again pointed out that the following examples are provided for illustrative purposes only and are not to place any limitation on the scope of the invention where such scope is set out only in the claims. All parts and percentages are by weight.

Typical compositions according to this invention are listed in the following table.

TABLE I

| COMPONENTS | A | B | C | D | E | F |
|---|---|---|---|---|---|---|
| Base Oil | 90.37 | 90.87 | 92.82 | 95 | 81.13 | 83.18 |
| Product of Example 4 | | | | | | 2.00 |
| Product of Example 5 | 0.11 | 0.11 | 3.86 | 2.50 | | |
| Product of Example 6 | | | | | 2.60 | |
| Reaction Product of Polybutenyl Succinic Anhydride with Ethylene Polyamine | | | | | 3.61 | 2.50 |
| Reaction Product of Polybutenyl Succinic Anhydride with Ethylene Polyamine and Pentaerythritol | | | | | | 2.50 |
| Reaction Product of Polybutenyl Succinic Anhydride with Ethylene Polyamine and Carbon Disulfide | 2.00 | 2.00 | | | | |
| Reaction Product of Polybutenyl Succinic Anhydride with Ethylene Polyamine and Boric Acid | 1.00 | 1.00 | | | | |
| Basic Calcium Alkylbenzene-sulfonate | 1.79 | 1.79 | | | | 1.10 |
| Basic Magnesium Alkylbenzene-sulfonate | | | | | 1.35 | 0.65 |
| Reaction Product of Maleic Anhydride-styrene Copolymer with Alcohol and Amine | 3.50 | 3.50 | 1.11 | | 0.20 | |
| Hydrogenated Styrenediene Block Copolymer Viscosity Improver | | | | | 9.00 | |
| Ethylene-propylene Copolymer Viscosity Improver | | | | | | 7.00 |
| Sulfurized Fat | 0.50 | | | | | |
| Reaction Product of an Organo Sulfur Cmpd. with an Epoxide | 0.50 | 0.50 | | | | |
| Sulfurized Olefin | | | | 2.50 | 1.50 | |
| Ester of Dimercapto-thiadiazole | | | 0.17 | | 0.10 | 0.06 |
| Sulfurized Diels-Alder Adduct | | | | | | 0.60 |
| Oil Soluble Phosphorus-Containing Extreme Pressure Agent | | | 1.47 | | | |
| Alkylated Arylamine | 0.10 | 0.10 | | | 0.50 | 0.30 |
| Ethoxylated Fatty Amine | 0.09 | 0.09 | | | | |
| Fatty Amide | | | 0.11 | | | 0.10 |
| Fatty Amine | | | 0.39 | | | |
| Silicone Anti-foam Agent | 0.042 | 0.042 | 0.066 | | 0.006 | 0.006 |

The products of the various examples, contained in a fully formulated lubricating composition as is described in Table I, were then tested with regard to a Timken "OK" load test as well as a contact pressure test in accordance with ASTM D 2782 with the exception that in the "OK" load test the following procedural differences were made:

1. Test cup and block surfaces are merely "wetted" with test lubricant (approximately 5 drops on block). No test sample is recirculated over the surfaces during the test.
2. Test duration is 5 minutes under load.
3. This procedure is run as an "OK" Load test, determining "OK" Load as in ASTM Test D 2782 except utilizing the following load increments:
   a. "OK" Load $\leqq$ 20 lbs.: Determine "OK" Load to the nearest 1 lb.
   b. "OK" Load > 20 lbs.: Determine "OK" Load using standard load increments as described in ASTM Test D 2782.

TABLE II

TIMKEN EVALUATION OF VARIOUS CARBAMATES

| Example | Percent By Weight | OK Load (lbs) | Contact Pressure (psi) |
|---|---|---|---|
| No Additive | | 12 | 5,783 |
| 2 | 1 | 15 | 8,450 |
| 4 | 2 | 17 | 7,850 |
| 5 | 2 | 25 | 11,025 |
| 5 | 1 | 17 | 6,900 |
| 6 | 2 | 20 | 10,150 |
| 6 | 1 | 20 | 7,800 |

While the invention has been described and illustrated with reference to certain preferred embodiments thereof, those skilled in the art will appreciate that various changes, modifications and substitutions can be made therein without departing from the spirit of the invention. For example, different concentration ranges other than the preferred ranges set forth hereinabove may be applicable as a consequence of variations in the oil base stock or the type of engine or the like. It is intended, therefore, that the invention be limited only by the scope of the claims which follow.

What is claimed is:

1. A low-phosphorus containing or phosphorus-free lubricating composition comprising a major amount of an oil of lubricating viscosity and a minor amount of an additive derived from reactants comprising:

(A) $CS_2$, COS or a source material therefor;

(B) an amine of the formula: R'R''NH, wherein R' and R'' are the same or different and are alkyl groups of 1 to about 7 carbon atoms, aryl or aralkyl, or together form an alicyclic or heteroalicyclic radical in which the ring is completed through the nitrogen, and (C) a reactant of the formula:

$$(CR_{10}R_{11}(CR')_x(R'_3)_b)Z \qquad \text{(II)}$$

wherein $R_{10}$ and $R_{11}$ are independently H, alkyl, aryl, Cl or Br; R' is H, alkyl, aryl or aralkyl; x is 0 or 1, b is 0 or 1 where x+b is 1; $R'_3$ is H, alkyl or aryl, chloro or bromo and Z is CN, $$\overset{O}{\overset{\|}{S}}{-}R_5,\ \overset{O}{\overset{\|}{S}}{-}OR_5,\ \underset{\underset{O}{\|}}{\overset{O}{\overset{\|}{S}}}{-}R_5,\ \underset{\underset{O}{\|}}{\overset{O}{\overset{\|}{S}}}{-}OR_5,\ \text{or}\ \overset{O}{\overset{\|}{C}}{-}Y,$$

wherein $R_5$ is H, alkyl or aralkyl, and wherein Y is H, OH, $R_6$ or $OR_6$ where $R_6$ is alkyl, aryl or aralkyl, $OR_7$—OH where $R_7$ is alkylene of 1 to about 7 carbon atoms and $NR_8R_9$ where $R_8$ and $R_9$ are independently H, alkyl, cycloaliphatic, heteroalicyclic or together form an alicyclic or heteroalicyclic radical in which the ring is completed through the nitrogen; with the proviso that when x is O, Y is not $OR_6$.

2. An additive for preparing a low-phosphorus containing or phosphorus-free lubricating oil, grease or automatic transmissions fluid derived from reactants comprising a major amount of an oil of lubricating viscosity and a minor amount of an additive derived from reactants comprising:

(A) $CS_2$, COS or a source material therefor;

(B) an amine of the formula: R'R''NH, wherein R' and R'' are the same or different and are alkyl groups of 1 to about 7 carbon atoms, aryl or aralkyl, or together form an alicyclic or heteroalicyclic radical in which the ring is completed through the nitrogen, and (C) a reactant of the formula:

$$(CR_{10}R_{11}(CR')_x(R'_3)_b)Z \qquad \text{(II)}$$

wherein $R_{10}$ and $R_{11}$ are independently H, alkyl, aryl, Cl or Br; R' is H, alkyl, aryl or aralkyl; x is 0 or 1, b is 0 or 1 where x+b is 1; $R'_3$ is H, alkyl or aryl, chloro or bromo and Z is CN, $$\overset{O}{\overset{\|}{S}}{-}R_5,\ \overset{O}{\overset{\|}{S}}{-}OR_5,\ \underset{\underset{O}{\|}}{\overset{O}{\overset{\|}{S}}}{-}R_5,\ \underset{\underset{O}{\|}}{\overset{O}{\overset{\|}{S}}}{-}OR_5,\ \text{or}\ \overset{O}{\overset{\|}{C}}{-}Y,$$

wherein $R_5$ is H, alkyl or aralkyl, and wherein Y is H, OH, $R_6$ or $OR_6$ where $R_6$ is alkyl, aryl or aralkyl, $OR_7$—OH where $R_7$ is alkylene of 1 to about 7 carbon atoms and $NR_8R_9$ where $R_8$ and $R_9$ are independently H, alkyl, cycloaliphatic, heteroalicyclic or together form an alicyclic or heteroalicyclic radical in which the ring is completed through the nitrogen; with the proviso that when x is O, Y is not $OR_6$.

3. A grease composition comprising the additive of claim 2.

4. An automatic transmission fluid comprising the additive of claim 2.

5. A hydraulic fluid comprising the additive of claim 2.

* * * * *